US005727930A

United States Patent [19]

Bennitt et al.

[11] Patent Number: 5,727,930

[45] Date of Patent: Mar. 17, 1998

[54] VALVES AND ROD ASSEMBLY

[75] Inventors: Robert A. Bennitt, Painted Post; Daniel Valla, Corning, both of N.Y.

[73] Assignee: Dresser-Rand Company, Corning, N.Y.

[21] Appl. No.: 691,066

[22] Filed: Aug. 1, 1996

[51] Int. Cl.[6] ..... F04B 21/04

[52] U.S. Cl. ..... 417/525; 417/454; 417/523; 417/534; 92/175; 92/255; 137/512

[58] Field of Search ..... 417/454, 523, 417/524, 525, 534, 535; 92/255, 175, 181 R; 137/512, 625.69

[56] References Cited

U.S. PATENT DOCUMENTS 5,011,383 4/1991 Bennitt ..... 417/534

5,015,158 5/1991 Bennitt ..... 417/525

5,141,413 8/1992 Bennitt ..... 417/523

*Primary Examiner*—Charles G. Freay

*Attorney, Agent, or Firm*—Bernard J. Murphy

[57] ABSTRACT

A hollow through-bolt is threaded internally and externally, at one end, to receive therein a reciprocable, end-threaded rod. A pair of fluid-control valves, centrally bored, are mounted on the through-bolt in spaced apart disposition. The other end of the through-bolt has a shoulder formed thereon for seating one of the valves thereagainst, and the other valve central bore is tapped for threaded engagement with the one end of the through-bolt. A sleeve, slidably engaged with the through-bolt, and interposed between the valves, maintains the one valve positioned against the shoulder.

10 Claims, 1 Drawing Sheet

FIG. 1
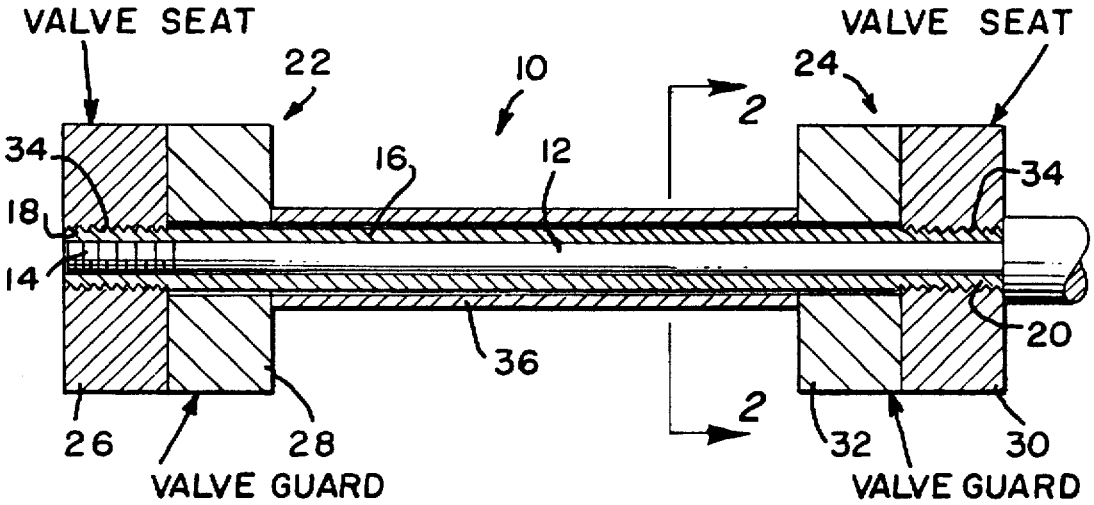
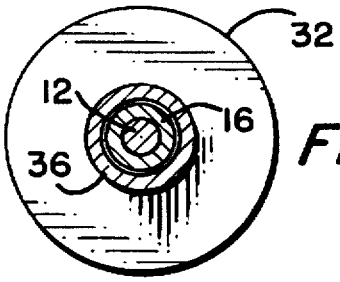
FIG. 2
FIG. 3
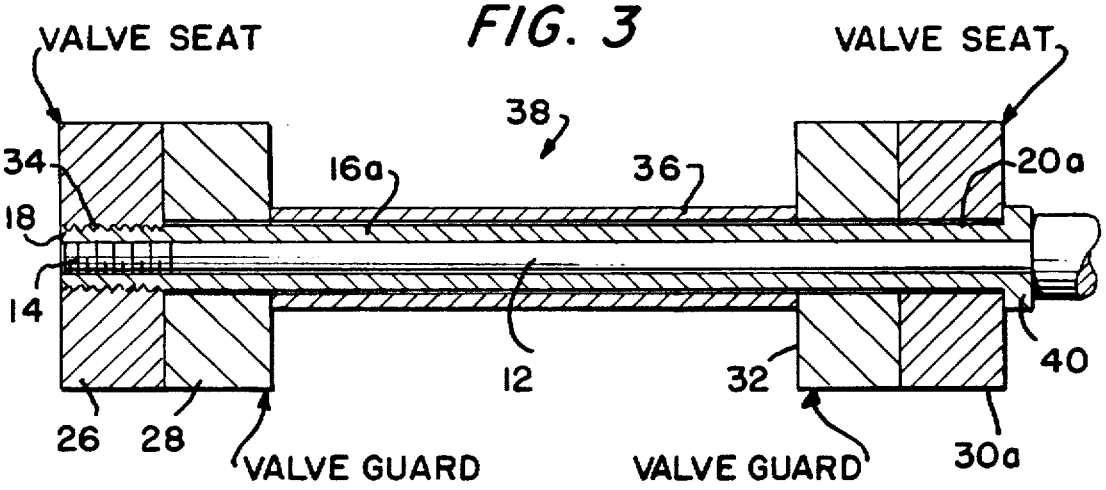

VALVES AND ROD ASSEMBLY

This invention pertains to one-way, fluid control valves, centrally-bored for mounting thereof on a reciprocatable rod, for defining a valves and rod assembly which is usable in a straight cylinder for working a fluid.

Such assemblies are known in the prior art, and exemplary thereof is the valves and rod assembly disclosed in the U.S. Pat. No. 5,011,383, issued on 30 Apr. 1991, for "A Valves Assembly, for Use in Combination with a Straight-Cylinder, Gas-Compression Chamber, and in Combination Therewith", to Robert A. Bennitt. In the cited patent there is depicted and described a reciprocable rod which is threaded at both ends thereof, and has a pair of shoulders formed thereon. The rod receives a pair of valves thereon, each valve having a centrally-bored valve seat and a centrally-bored valve guard, wherein the valves seat is further threaded for torqued engagement with one of the threaded ends of the rod. In addition, the valve guards are set against the shoulders. Finally, one end of the rod is centrally bored and tapped for threaded coupling thereof to a reciprocating shaft of a prime mover.

Notwithstanding the merits of the patented valves and rod assembly, there obtains a need for a valves and rod assembly of differing construction which provides greater stretch, and which, nonetheless is as efficient and solid a structure as the patented assembly.

It is an object of this invention, then, to set forth a valves and rod assembly which meets the aforesaid need. Particularly, it is an object of this invention to disclose a novel valves and rod assembly comprising a hollow through-bolt; said bolt being externally and internally threaded at one end; an elongate rod, threaded at one end, and threadedly engaged with internal threads of said through-bolt; valve guards mounted on said through-bolt in spaced apart disposition; a first valve seat, having a central, tapped hole, threadedly engaged with external threads of said through-bolt; and a second valve seat mounted on said through-bolt remote from said first valve seat; wherein said through-bolt has means formed thereon for holding said valve seat positioned thereon; and means interposed between said guards for maintaining said spaced apart disposition.

It is also an object of this invention to set forth a valves and rod assembly comprising a hollow through-bolt; said through-bolt being externally and internally threaded at one end thereof; an elongate rod, threaded at one end thereof, confined within said through-bolt, and having one end thereof threadedly engaged with internal threads of said through-bolt; and a pair of valves mounted on said through-bolt, each of said valves being on a given end of said through-bolt; wherein each of said valves has a first element comprising a valve guard, and a second element comprising a valve seat; one of said first and second elements of one of said valves has a central, tapped hole, threadedly engaged with external threads of said through-bolt; and said through-bolt has means formed thereon for holding the other of said valves positioned thereon; and means interposed between said valves for maintaining said valves on said through-bolt in a spaced apart disposition.

Further objects of this invention, as well as the novel features thereof, will be apparent by reference to the following description, taken in conjunction with the accompanying figures, in which:

FIG. 1 is side view, partly cross-sectioned, of an embodiment of the invention;

FIG. 2 is a cross-section taken along section 2—2 of FIG. 1; and

FIG. 3 is a side view, generally corresponding to that of FIG. 1, albeit of an alternative embodiment of the invention.

In the figures the valves are depicted in simple line illustration. For the purposes of this disclosure, it is to be understood that the valves correspond, generally, to those shown in the aforesaid U.S. Pat. No. 5,011,363. Consequently, for a clear understanding of the valves comprehended by this disclosure, the cited U.S. Pat. No. 5,011,383 is hereby incorporated by reference.

As shown in FIGS. 1 and 2, the novel valves and rod assembly 10 comprises an elongate rod 12 which is threaded at one end 14 thereof. Rod 12 is confined within a hollow through-bolt 16, and through-bolt 16 is externally and internally threaded at one end 18 thereof, and has external threads at the opposite end 20. Valves 22 and 24 are mounted on the through-bolt 16. Valve 22 comprises a valve seat 26 and a valve guard 28. Likewise, valve 24 comprises a valve seat 30 and a valve guard 32. The valve seats 26 and 30 have central, tapped holes 34, and are threadedly engaged with the external threads of the through-bolt 16 at ends 18 and 20 thereof. The guards 28 and 32 are in engaged juxtaposition with the seats 26 and 30, respectively, each thereof being centrally bored to accommodate the mounting thereof onto the through-bolt 16. A spacer 36 is interposed between the guards 28 and 32, having ends thereof set against the confronting faces of the guards 28 and 32.

Assembly 10 is a solid, strong structure which, with the valve seats 26 and 30 firmly torqued onto the ends 18 and 20 of the through-bolt 16, and the rod 12 extending fully through the through-bolt 16, and tightly torqued in the end 18 of the through-bolt, provides a considerable stretch axially to the elongated rod 12. Too, the spacer 36 provides added stretch to the through-bolt 16.

In the FIG. 1 and 2 embodiment of the invention, the threading at end 20 of the through-bolt 16 comprises a means for holding the internally-threaded valve seat 30 positioned on the bolt 16. FIG. 3 depicts an alternative embodiment of the invention in which such threading, of the valve seat 30 and the end 20 of the through-bolt 16 is obviated. The valves and rod assembly 38 of FIG. 3 is substantially similar to that comprised by the assembly 10 of FIGS. 1 and 2, except that the end **20*a* of the through-bolt 16*a* has a shoulder 40 formed thereon, and valve seat 30*a* is centrally bored but is not tapped. Valve seat 30*a* is compressed against the shoulder 40 and, otherwise, assembly 38 is of the same structure as assembly 10**.

While we have described our invention in connection with specific embodiments thereof, it is to be clearly understood that this is done only by way of example, and not as a limitation to the scope of our invention, as set forth in the objects thereof and in the appended claims.

We claim:

1. A valves and rod assembly, comprising:

a hollow through-bolt;

said bolt being externally and internally threaded at one end;

an elongate rod, threaded at one end, and threadedly engaged with internal threads of said through-bolt;

valve guards mounted on said through-bolt in spaced apart disposition;

a first valve seat, having a central, tapped hole, threadedly engaged with external threads of said through-bolt; and a second valve seat mounted on said through-bolt remote from said first valve seat; wherein said through-bolt has means formed thereon for holding said second valve seat positioned thereon; and means interposed between, and abuttingly engaging, said guards, for (a) maintaining said spaced apart disposition thereof, and (b) effecting stretch in said through-bolt.

2. A valves and rod assembly, according to claim 1, wherein:

said second valve seat has a central, tapped hole;

said holding means comprises threading on an end of said through-bolt which is opposite said one end thereof; and said tapped hole of said second valve seat is threadedly engaged with said threading of said opposite end of said through-bolt.

3. A valves and rod assembly, according to claim 1, wherein:

said elongate rod is confined within said through-bolt.

4. A valves and rod assembly, according to claim 1, wherein:

said first valve seat and one of said valve guards are in engaged juxtaposition; and said second valve seat, and another of said valve guards are in engaged juxtaposition.

5. A valves and rod assembly, comprising:

a hollow through-bolt;

said bolt being externally and internally threaded at one end;

an elongate rod, threaded at one end, and threadedly engaged with internal threads of said through-bolt;

valve guards mounted on said through-bolt in spaced apart disposition;

a first valve seat, having a central, tapped hole, threadedly engaged with external threads of said through-bolt; and a second valve seat mounted on said through-bolt remote from said first valve seat; wherein said through-bolt has means formed thereon for holding said second valve seat positioned thereon; and means interposed between said guards for maintaining said spaced apart disposition thereof; wherein said second valve seat has a central borehole;

said holding means comprises a shoulder on an end of said through-bolt which is opposite said one end thereof; and said second valve seat is set against said shoulder.

6. A valves and rod assembly, comprising:

a hollow through-bolt;

said through-bolt being externally and internall threaded at one end thereof;

an elongate rod, threaded at one end thereof, confined within said through-bolt, and having said one end thereof threadedly engaged with internal threads of said through-bolt; and a pair of valves mounted on said through-bolt, each of said valves being on a given end of said through-bolt; wherein each of said valves has a first element comprising a valve guard, and a second element comprising a valve seat;

one of said first and second elements of one of said valves has a central, tapped hole, threadedly engaaged with external threads of said through-bolt; and said through-bolt has means formed thereon for holding the other of said valves positioned thereon; and means interposed between, and abuttingly engaging, said valves, for (a) maintaining said valves on said through-bolt in a spaced apart disposition, and (b) effecting stretch in said through-bolt.

7. A valves and rod assembly, according to claim 6, wherein:

one of said first and second elements of said other valve has a central, tapped hole formed therein;

said holding means of said through-bolt comprises external threading formed on the end thereof which is opposite said one end thereof; and said one element of said other valve is threadedly engaged with external threading of said opposite end of said through-bolt.

8. A valves and rod assembly, comprising:

a hollow through-bolt;

said through-bolt being externally and internally threaded at one end thereof;

an elongate rod, threaded at one end thereof, confined within said through-bolt, and having said one end thereof threadedly engaged with internal threads of said through-bolt; and a pair of valves mounted on said through-bolt, each of said valves being on a given end of said through-bolt; wherein each of said valves has a first element comprising a valve guard, and a second element comprising a valve seat;

one of said first and second elements of one of said valves has a central, tapped hole, threadedly engaged with external threads of said through-bolt; and said through-bolt means formed thereon for holding the other of said valves positioned thereon; and means interposed between said valves for maintaining said valves on said through-bolt in a spaced apart disposition, wherein said holding means comprises a shoulder formed on said through-bolt on the end thereof which is opposite said one end thereof.

9. A valves and rod assembly, comprising:

a hollow through-bolt;

said through-bolt being externally and internally threaded at one end thereof;

an elongate rod, threaded at one end thereof, confined within said through-bolt, and having one end thereof threadedly engaged with internal threads of said through-bolt; and a pair of valves mounted on said through-bolt, each of said valves being on a given end of said through-bolt; wherein each of said valves has a first element comprising a valve guard, and a second element comprising a valve seat;

one of said first and second elements of one of said valves has a central, tapped hole, threadedly engaged with external threads of said through-bolt; and said through-bolt has means formed thereon for holding the other of said valves positioned thereon; and means interposed between said valves for maintaining said valves on said through-bolt in a spaced apart disposition; wherein said interposed means comprises a spacer, in envelopment of said through-bolt, and having opposite ends thereof set against confronting faces of said valves.

10. A through-bolt, for use in a valves and rod assembly, comprising:

an elongated bolt; wherein said bolt is hollow fully throughout the length thereof;

one end of said bolt is threaded internally and externally; and the end of said bolt opposite said one end thereof has means formed thereon for holding a bored-through valve element positioned thereat; wherein said valve element holding means comprises a shoulder.

* * * * *